US005335053A

United States Patent [19]

Hasegawa

[11] Patent Number: 5,335,053

[45] Date of Patent: Aug. 2, 1994

[54] IMAGE FORMING APPARATUS WITH GROUNDED CONDUCTIVE MEMBER CONTACTING A RECORDING SHEET BEARING MEMBER

[75] Inventor: Takashi Hasegawa, Ageo, Japan

[73] Assignee: Canon Kabushiki Kaisha, Tokyo, Japan

[21] Appl. No.: 32,489

[22] Filed: Mar. 17, 1993

[30] Foreign Application Priority Data

Mar. 17, 1992 [JP] Japan ..... 4-091594

[51] Int. Cl.[5] ..... G03G 15/16

[52] U.S. Cl. ..... 355/274; 355/219; 361/225

[58] Field of Search ..... 355/219, 271, 274, 276, 355/326, 327; 118/645; 361/225, 230

[56] References Cited

U.S. PATENT DOCUMENTS 4,912,516 3/1990 Kaieda ..... 355/274
5,172,173 12/1992 Goto et al. ..... 355/274 X
5,227,851 7/1993 Yoshida et al. ..... 355/271

FOREIGN PATENT DOCUMENTS 0487046 5/1992 European Pat. Off. ..... 355/274
0232478 10/1986 Japan ..... 355/274
0148075 6/1990 Japan ..... 355/274
0051865 3/1991 Japan ..... 365/326

*Primary Examiner*—A. T. Grimley
*Assistant Examiner*—William J. Royer
*Attorney, Agent, or Firm*—Fitzpatrick, Cella, Harper & Scinto

[57] ABSTRACT

The present invention provides an image forming apparatus with a recording sheet bearing member for bearing a recording sheet on which an image is to be formed, a charger brush contacting with a surface of the recording sheet bearing member opposite to a surface thereof on which the recording sheet is carried, and adapted to apply charge to the carrying member, and a grounded conductive member arranged out of a range of movement of a tip of the charger brush.

18 Claims, 6 Drawing Sheets

IMAGE FORMING APPARATUS WITH GROUNDED CONDUCTIVE MEMBER CONTACTING A RECORDING SHEET BEARING MEMBER

BACKGROUND OF THE INVENTION

1. Field of the Invention

The present invention relates to an image forming apparatus such as a copying machine, a printer and the like, having a transfer device wherein a transfer sheet is adhered onto a transfer sheet bearing member (such as a transfer belt, transfer drum or the like) and a toner image formed on an image bearing member is transferred onto the transfer sheet by applying an adsorption electric field or a transfer electric field to the transfer sheet bearing member by a charger brush arranged inside of the transfer sheet bearing member.

2. Related Background Art

In image forming apparatuses such as copying machines, printers and the like, it is known that a toner image formed on an image bearing member is transferred onto a recording sheet (transfer sheet) by applying a transfer electric field to a transfer sheet bearing member (transfer belt, transfer drum or the like) constituting a transfer device by a transfer charger brush (transfer electric field applying means) of contact type arranged inside of the transfer sheet bearing member. Further, it is considered that an adsorption charger brush contacting an inner surface of a transfer sheet bearing member (transfer drum) is provided for electrostatically adhering a transfer sheet to the transfer sheet bearing member.

On the other hand, as a transfer device, generally, a transfer drum comprising a pair of opposed ring portions, a connecting portion interconnecting the ring portions, and a transfer sheet bearing film covering an opening defined by the ring portions and the connecting portion is well known.

However, in such a transfer device, as shown in FIG. 10, when conductive or semi-conductive fibers 17 and/or 27 of a transfer charger brush 15 and/or an adsorption charger brush 25 become fatigued due to a long term use thereof, as shown in FIG. 11, the fibers are bent outwardly to contact with the ring portions 5*a* of the transfer drum 5, with the result that, when the transfer high voltage and the adsorption high voltage from the respective electric sources (not shown) are applied to the transfer charger brush 15 and the adsorption charger brush 25, the electric currents are leaked through the ring portions 5*a*. Particularly, as in the illustrated transfer device, when the transfer sheet is adhered to and held by the transfer film 5*f* and the toner image formed on a photosensitive drum 1 is transferred onto the transfer sheet via the transfer film 5*f*, since the fibers 17 and 27 of the transfer charger brush 15 and the adsorption charger brush 25 are urged against the inner surface of the transfer film 5*f* with a relatively great force, the above problem is arisen at a relatively initial stage of the use of the transfer device, which results in a malfunction of the apparatus.

In the above-mentioned transfer device, although the adsorption charger brush 25 is provided as well as the transfer charger brush 15, even if the transfer charger brush acts also as an adsorption charger brush, the same problem will occur.

SUMMARY OF THE INVENTION

An object of the present invention is to provide an image forming apparatus which can prevent an electric current from leaking to conductive parts such as a recording sheet bearing member.

Another object of the present invention is to provide an image forming apparatus wherein the charge is effectively applied to a recording sheet bearing member by a charger brush.

A further object of the present invention is to provide an image forming apparatus wherein an image is effectively formed on a recording sheet or a recording sheet is effectively adhered to a recording sheet bearing member.

The other objects and features of the present invention will be apparent from the following description referring to the accompanying drawings.

DETAILED DESCRIPTION OF THE PREFERRED EMBODIMENTS

Figure 8:
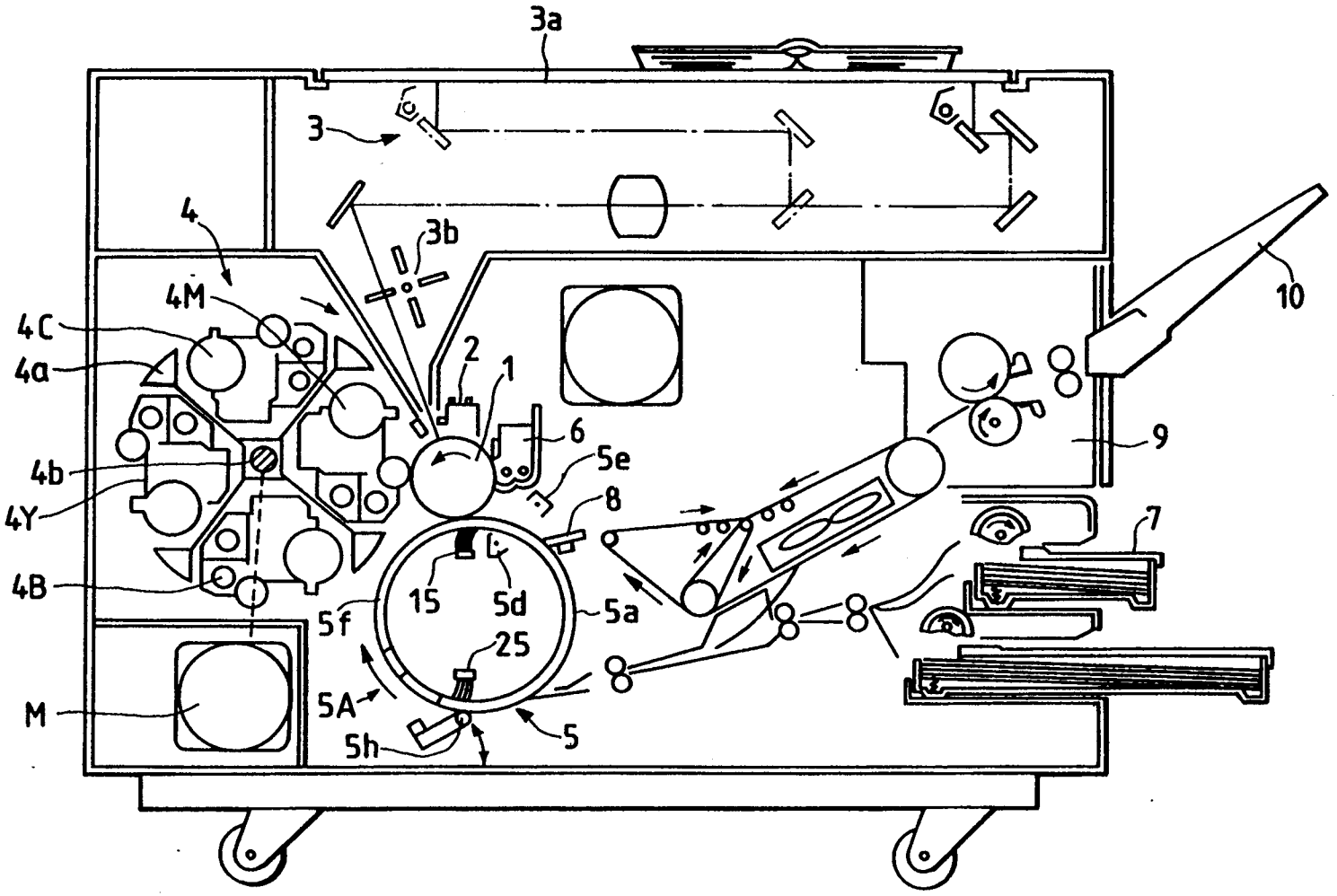
FIG. 8 is an elevational sectional view of an image forming apparatus.

FIG. 8 is an elevational sectional view of an electrophotographic color copying machine as an image forming apparatus for forming a full-color image.

As shown in FIG. 8, the electrophotographic color copying machine comprises a photosensitive drum 1 around which a corona charger 2, an optical exposure system 3, a developing means 4, a transfer device 5A and a cleaning device 6 are disposed. The optical exposure system 3 comprises an original scanning portion 3*b* and a color decomposing filter 3*a*. The developing means 4 includes four different color developing devices disposed around a central shaft 4*b* of a frame 4*a*, i.e., a yellow developing device 4Y, a magenta developing device 4M, a cyan developing device 4C and a black developing device 4B. The developing means can be rotated by means of motor M around the central shaft 4*b* to bring these developing devices to a developing station successively.

Figure 1:
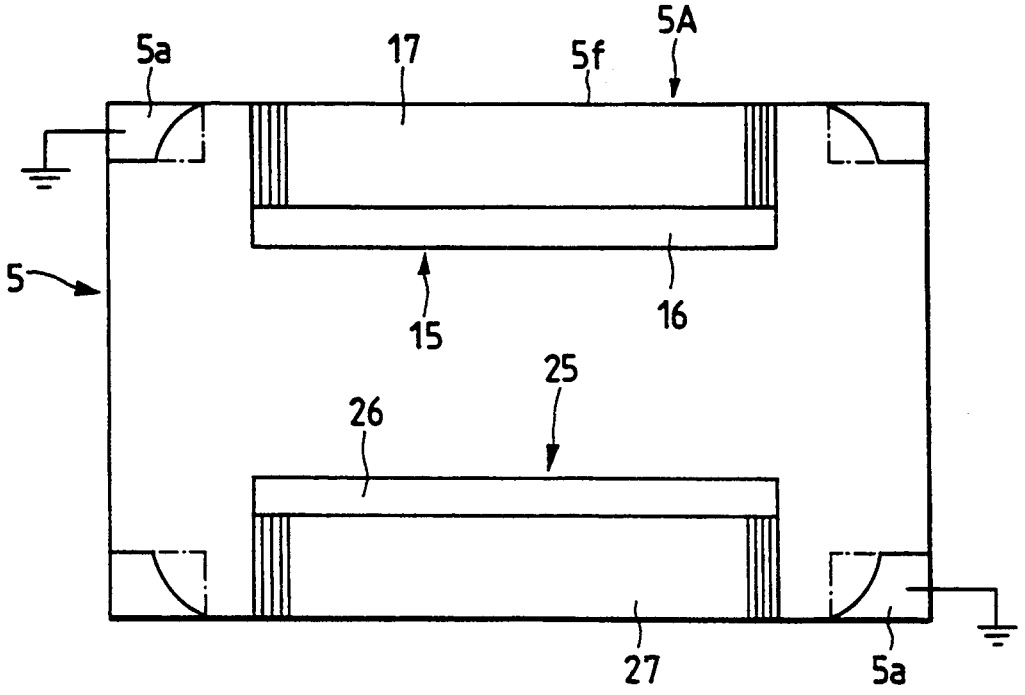
FIG. 1 is a schematic sectional view of a transfer drum of a transfer device of an image forming apparatus according to a preferred embodiment of the present invention.
Figure 9:
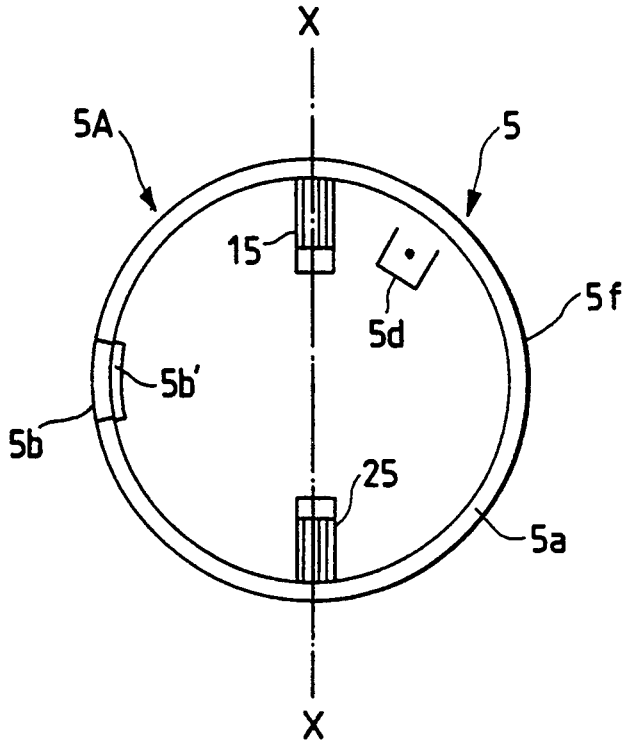
FIG. 9 is a cross sectional view of a transfer drum of a transfer device used with the image forming apparatus of FIG. 8.
Figure 10:
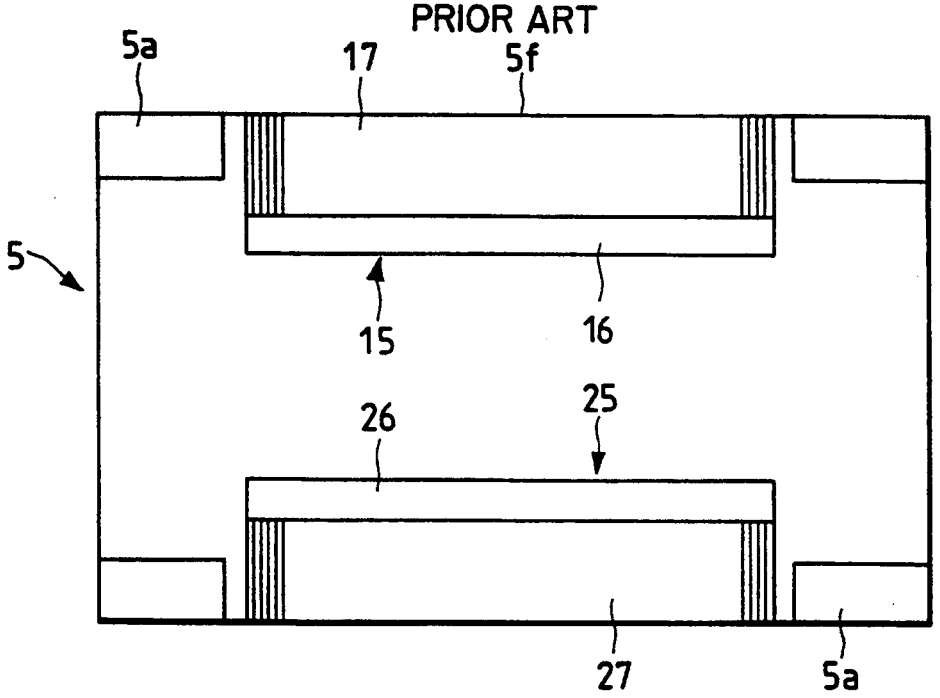
FIG. 10 PRIOR ART
FIG. 10 is a sectional view taken along the line X—X of FIG. 9.

The transfer device 5A has a transfer drum 5. As shown in FIG. 9 illustrating a cross-section of the drum and in FIG. 1 illustrating a longitudinal section of the drum, the transfer drum 5 comprises a frame including a pair of rings 5*a* and a connecting member 5*b* interconnecting the rings, and a transfer film (transfer sheet bearing member) 5*f* covering an opening formed in the frame and defined by the rings and the connecting member. The rings 5*a* are made of aluminium, and the connecting member 5*b* is made of SUS. For the insulation purpose, an inner surface of the connecting member 5*b* is covered by an acrylic cover 5*b*'. The transfer film 5*f* comprises a sheet made of PVdF (polyvinylidene fluoride) having a thickness of about 150 μm.

Within the transfer drum 5, a transfer charger brush 15 (transfer electric field applying means) of contact type is arranged at an image transferring station opposed to the photosensitive drum 1. In this transfer device 5A, there is also arranged an adsorption charger brush (adsorption electric field applying means) 25 of contact type, which is opposed to the transfer charger brush 15 within the transfer drum 5. Further, within the transfer drum 5, there is also arranged an inner charge removing charger 5*d* which is disposed near the transfer charger brush 15 at a downstream side thereof.

The transfer charger brush 15 comprises a flat brush having a brush base 16 extending in a direction same as an axial direction of the transfer drum 5, and conductive or semi-conductive brush fibers 17 uprightly mounted on the brush base. For example, fibers (each having a diameter of about 20 μm) made of SA - 7 (registered trade mark: carbon fibers obtained by dispersing carbon in acrylic resin) manufactured by Toray Co., Ltd. in Japan are mounted on the brush base 16 with the density 20,000/inch$^2$ as the fibers 17 each having a free length of 30 mm, thereby obtaining the flat brush. Similarly, the adsorption charger brush 25 comprises a flat brush formed in a manner similar to the brush 15 and having a brush base 26 extending in a direction same as the axial direction of the transfer drum 5, and fibers 27 uprightly mounted on the brush base.

Further, outside the transfer drum 5, there are arranged an adsorption roller 5*h* opposed to the adsorption charger brush 25, an outer charge removing charger 5*e* opposed to the inner charge removing charger 5*d*, and a separation claw 8 disposed at a downstream side of the charger 5*e*.

In forming a color image, first of all, a green color decomposed electrostatic latent image is formed on the photosensitive drum 1, and the latent image is developed by the magenta developing device 4M to form a magenta toner image. On the other hand, a transfer sheet (recording sheet) is supplied from a sheet supply cassette 7, which transfer sheet is sent to the transfer drum 5 through a convey mechanism, and then a leading end portion of the transfer sheet is adhered onto the transfer film 5*f* of the transfer drum by charging the transfer film 5*f* by means of the adsorption charger brush 25 and the counter adsorption roller 5*h* to apply the adsorption charge to the transfer film. The transfer sheet held on the transfer film 5*f* is rotated together with the transfer drum 5 to pass through the image transferring station opposed to the photosensitive drum 1; meanwhile, the toner image on the photosensitive drum 1 is transferred onto the transfer sheet by applying the transfer charge to the transfer film 5*f* by charging it by the transfer charger brush 15 abutted against the inner surface of the transfer film 5*f*. At the same time, by the transfer charge, the transfer sheet is adhered to and held by the transfer film 5*f* more firmly.

Similar image forming processes are effected regarding cyan, yellow and black colors. As a result, the magenta toner image, cyan toner image, yellow toner image and black toner image are transferred onto the transfer sheet in a superimposed fashion, thereby obtaining a color image. After four color toner images are transferred to the transfer sheet, the transfer sheet is separated from the transfer drum 5 by the charge removing chargers 5*d*, 5*e* and the separation claw 8 and then is sent to a heat roller fixing device 9, where the color toner images are fused and color-mixed to form a permanent full-color image. Thereafter, the transfer sheet is discharged onto a tray 10.

In this embodiment, as shown in FIG. 1, in order to prevent the conductive or semi-conductive fibers 17, 27 of the transfer charger brush 15 and the adsorption charger brush 25 from expanding outwardly and bending into contact with the rings 5*a* of the transfer drum 5 due to the fatigue of the fibers in consequence of the continuous use or the long term use thereof, circumferential areas (shown by the phantom lines) of the rings 5*a* against which the fibers may be contacted are omitted or cut out.

Figure 2:
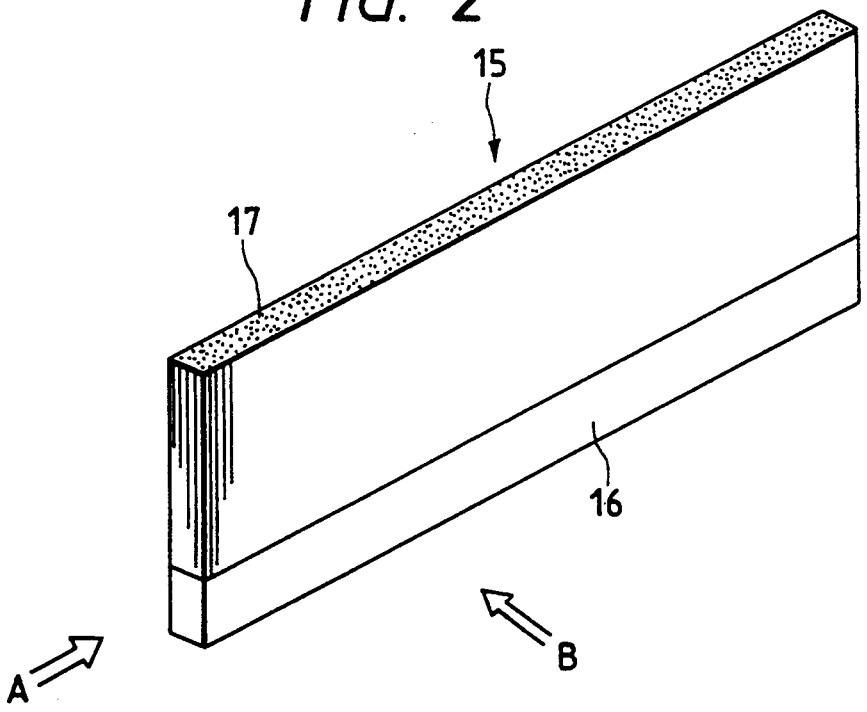
FIG. 2 is a perspective view of a transfer charger brush provided within the transfer drum.
Figure 3A:
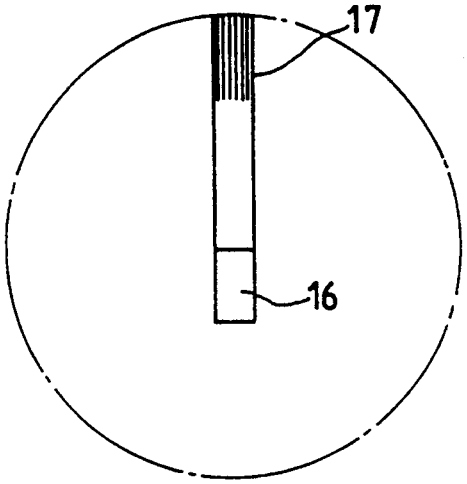
FIGS. 3A and 3B are views showing geometrical traces described by tips of fibers of the transfer charger brush.
Figure 3B:
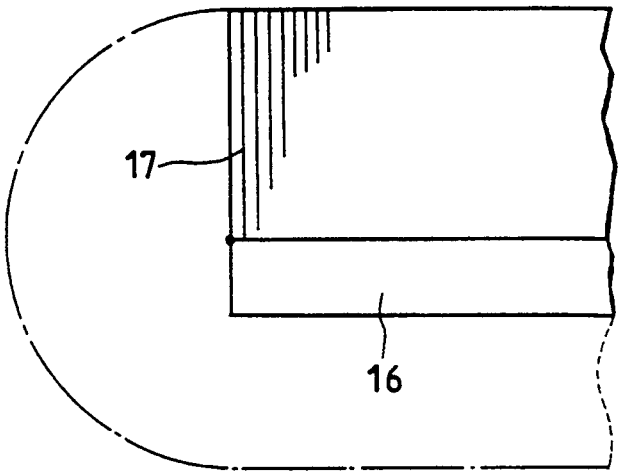

If the fibers 17 of the transfer charger brush 15 become fatigued due to the continuous use or the long term use thereof, the fibers 17 of the brush 15 may be expanded within a range defined by the traces (as shown by the dot and chain lines in FIGS. 3A and 3B) described by the tips of the fibers, looked at from a direction A (FIG. 2) corresponding to a longitudinal direction of the brush base 16 (axial direction of the transfer drum 5) and a direction B perpendicular to the direction A. Similarly, the fibers 27 of the adsorption charger brush 25 may also be expanded within a similar range defined by the traces (as shown by the dot and chain lines in FIGS. 3A and 3B) described by the tips of the fibers. Thus, as mentioned above, in order to prevent the contact between the rings 5*a* and the fibers 17, 27, the circumferential areas (shown by the dot and chain line) of the rings 5*a* along the longitudinal direction of the transfer drum 5 are cut out. The amount of the cut-out is greater than the ranges within which the fibers 17, 27 are expanded. Incidentally, the rings 5*a* are grounded directly or via impedance elements such as resistor elements.

In this way, in the illustrated embodiment, even when the fibers 17, 27 of the transfer charger brush 15 and the adsorption charger brush 25 become fatigued to expand outwardly or to be bent due to the continuous use or the long term use thereof, the fibers 17, 27 do not contact with the rings 5*a* of the transfer drum 5, with the result that, when the transfer high voltage and the adsorption high voltage from the respective electric sources (not shown) are applied to the transfer charger brush 15 and the adsorption charger brush 25, respectively, the applied voltages are not leaked through the rings 5*a*. Accordingly, the transfer charge and the adsorption charge can be applied to the transfer film 5*f* effectively, thus permitting the transferring of the toner image on the photosensitive drum onto the transfer sheet.

Figure 4:
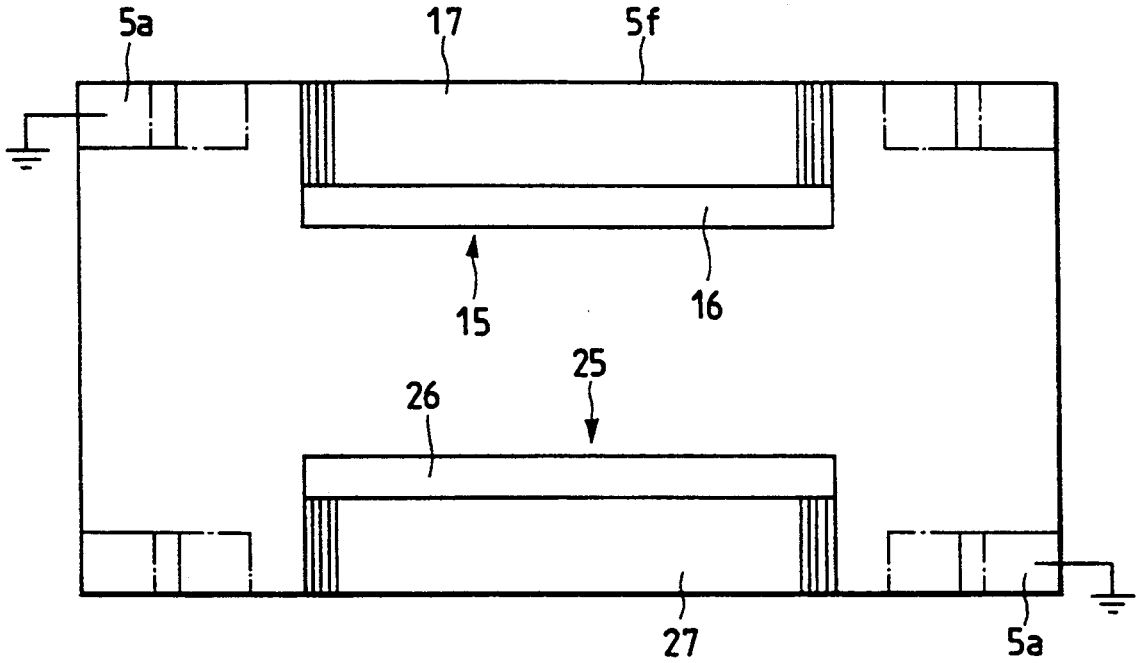
FIG. 4 is a schematic sectional view of a transfer drum of a transfer device of an image forming apparatus according to another embodiment of the present invention.

FIG. 4 is a longitudinal sectional view of a transfer drum of a transfer device according to another embodiment of the present invention.

In this embodiment, a distance between the left and right rings 5*a* of the transfer drum 5 is increased from a distance between positions shown by the dot and chain lines to a distance between positions shown by the solid lines so that the rings 5*a* are further spaced apart from the transfer charge brush 15 and the adsorption charger brush 25. In this way, even when the fibers 17, 27 of the transfer charger brush 15 and the adsorption charger brush 25 become fatigued to expand outwardly or to be bent, the fibers 17, 27 do not contact with the rings 5*a* of the transfer drum 5.

According to this embodiment, since it is not required to perform the cutting operation for the rings 5*a* of the transfer drum 5 as shown in FIG. 1, and the contact between the rings 5*a* and the fibers 17, 27 of the transfer charger brush 15 and the adsorption charger brush 25, and, thus, the leakage of the transfer high voltage and the adsorption high voltage through the rings 5*a* can be prevented only by increasing the distance between the rings 5*a* and by using a wider transfer films 5*f* accordingly, the prevention of the leakage can be achieved more cheaply.

Figure 5:
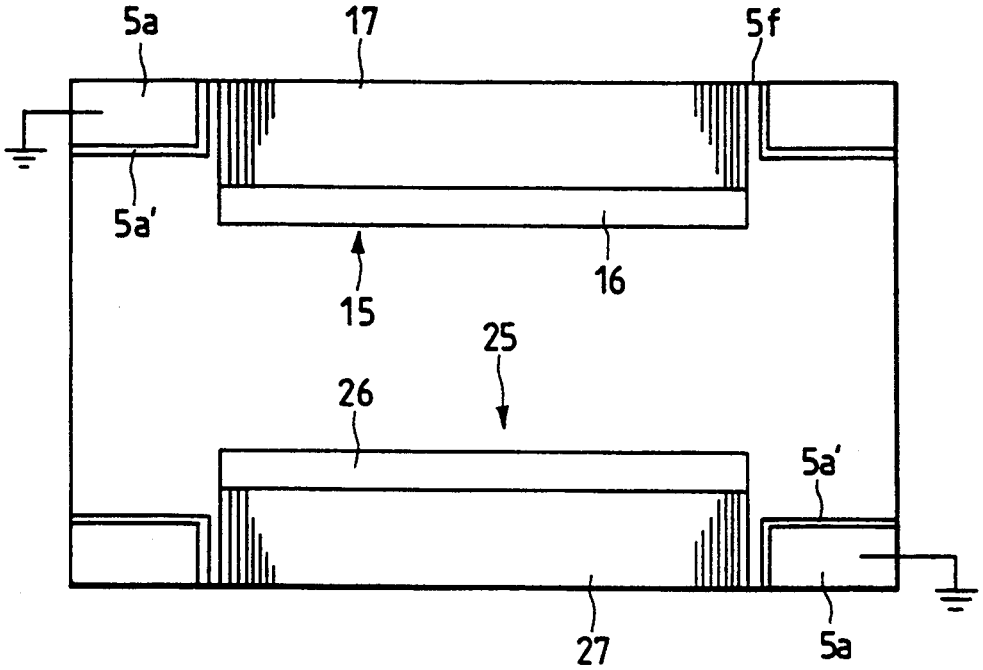
FIG. 5 is a schematic sectional view of a transfer drum of a transfer device of an image forming apparatus according to a further embodiment of the present invention.

FIG. 5 is a longitudinal sectional view of a transfer drum of a transfer device according to a further embodiment of the present invention.

In this embodiment, inner surfaces 5*a*' of the rings 5*a* of the transfer drum 5 are coated by insulator such as ABS (acrylonitrile butadiene styrene) resin. Although a thickness of the ABS resin used for the coating depends upon the voltages applied to the transfer charger brush 15 and the adsorption charger brush 25, it is sufficient to have a value of at least 200 μm when DC voltage of about 0–8 kV is used, or at least 500 μm when the AC voltage is overlapped with the DC voltage.

In this way, according to this embodiment, even when the fibers 17, 27 of the transfer charger brush 15 and the adsorption charger brush 25 become fatigued to expand outwardly or to be bent due to the continuous use or the long term use thereof, and are contacted with the rings 5*a* of the transfer drum 5, since the insulator coatings are provided on the inner surfaces 5*a*' of the rings 5*a*, it is possible to prevent the transfer high voltage and the adsorption high voltage from leaking through the rings 5*a*.

Figure 6:
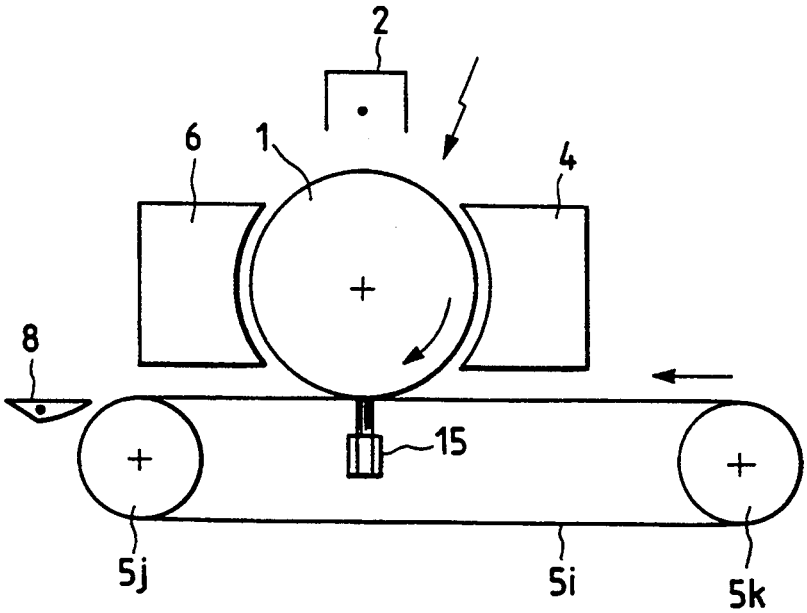
FIG. 6 is a schematic sectional view of an image forming apparatus having a transfer device according to a still further embodiment.

FIG. 6 is a schematic sectional view of an image forming apparatus having a transfer device according to a still further embodiment of the present invention.

This image forming apparatus has a photosensitive drum 1 around which a charger 2, developing means 4 and a cleaning device 6 are arranged, and a transfer belt (transfer sheet bearing member) 5*i* disposed below the photosensitive drum 1 and supported by a drive roller 5*j* and a driven roller 5*k*. Inside the transfer belt 5*i*, a transfer charger brush 15 is arranged in a confronting relation to the photosensitive drum 1. The transfer belt 5*i* and the transfer charger brush 15 constitute a transfer device. At a downstream side of the transfer belt 5*i* in a rotational direction thereof, there is arranged a separation claw 8 for separating a transfer sheet (not shown) on which a toner image formed on the photosensitive drum 1 was transferred by the transfer device, from the transfer belt 5*i* carrying the transfer sheet.

Figure 7:
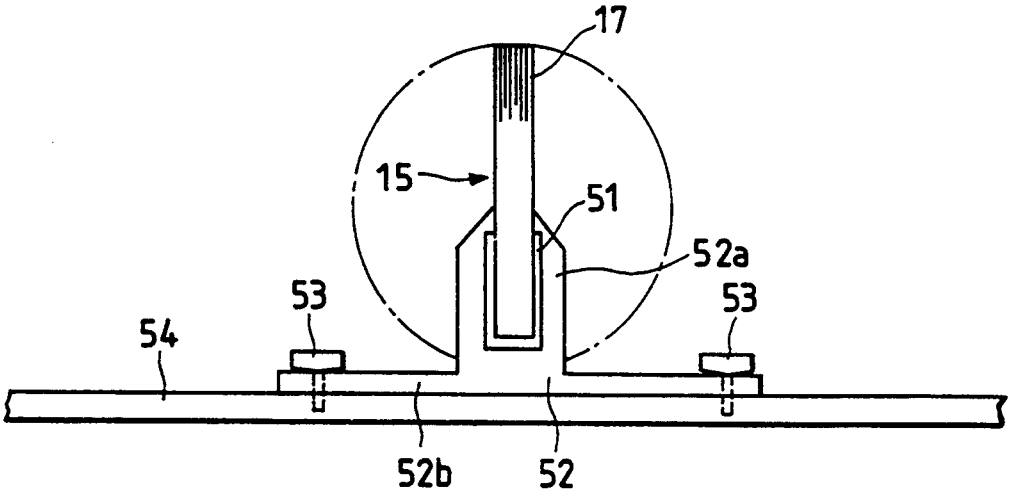
FIG. 7 is a sectional view of a transfer charger brush of the transfer device of FIG. 6.
Figure 11:
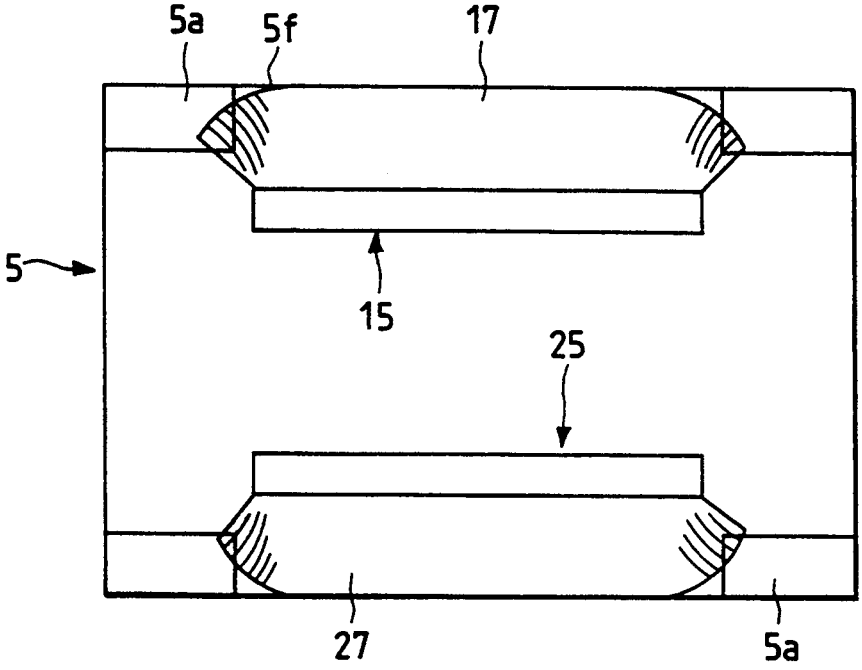
FIG. 11 PRIOR ART
FIG. 11 is a sectional view showing a condition that charger brushes in the transfer drum of FIG. 10 are contacted with ring portions of the drum.

According to this embodiment, as shown in FIG. 7, the transfer charger brush 15 comprises conductive or semi-conductive fibers 17 attached to an attachment portion 52*a* of an insulative support plate 52 via a bracket 51. The support plate 52 has a flat portion 52*b* extending perpendicular to the attachment portion 52*a*. The support plate 52 is secured to a frame 54 of the transfer device at a peripheral portion of the flat portion 52*b* by screws 53. The screws 53 are positioned out of a range defined by a trace (shown by the dot and chain line) described by the tips of the fibers 17 of the brush 15.

The transfer sheet (not shown) supplied onto the transfer belt 5*i* is adhered to and held by the transfer belt 5*i* by applying the adsorption charge to the transfer belt by an exclusive adsorption charger means or by applying the transfer charge to the transfer belt by the transfer charger brush 15. However, even when the fibers 17 of the transfer charger brush 15 become fatigued to expand outwardly or to be bent, since there is no conductive part within the range of the expanded fibers, the leakage does not occur.

As mentioned above, since the charger brush having the conductive or semi-conductive fibers abutted against the inner surface of the transfer sheet carrying member (such as the transfer film of the transfer drum) is prevented from directly contacting with the conductive parts of the transfer device (such as the rings of the transfer drum) even when the fibers become fatigued to expand outwardly or to be bent due to the long term use thereof, it is possible to prevent the high voltage applied to the charger brush from leaking. Thus, the transfer charge and the adsorption charge can be applied effectively, and, therefore, the transfer sheet can be adhered to the transfer sheet carrying member and/or the toner image can be transferred onto the transfer sheet.

What is claimed is:

1. An image forming apparatus, comprising:

a recording sheet bearing member for bearing a recording sheet on which an image is to be formed;

a charger brush contacting a surface of said recording sheet bearing member opposite to a surface thereof on which the recording sheet is born and adapted to apply charge to said recording sheet bearing member; and a grounded conductive member arranged out of a range of movement of a tip of said charger brush, wherein said conductive member has opposed ring portions between which said charger brush is disposed, and said ring portions support said recording sheet bearing member.

2. An image formed apparatus according to claim 1, wherein said conductive member is grounded via a resistor.

3. An image forming apparatus according to claim 1, wherein said ring portions have cut-outs so that said ring portions are not contacted with said charger brush.

4. An image forming apparatus according to claim 1, further comprising an image bearing member, and wherein an image formed on said image bearing member is transferred onto the recording sheet born by said recording sheet bearing member.

5. An image forming apparatus according to claim 1, wherein, before the image is formed on the recording sheet, said recording sheet can be electrostatically adhered to said recording sheet bearing member.

6. An image forming apparatus according to claim 4, wherein the image formed on said image bearing member is transferred onto the recording sheet born by said recording sheet bearing member, by means of said charger brush.

7. An image forming apparatus according to claim 4, wherein a plurality of color images can be formed on said image bearing member, and said plurality of color images are successively transferred onto the recording sheet carried by said recording sheet bearing member in a superimposed fashion.

8. An image forming apparatus according to claim 7, wherein the image forming apparatus can form a full-color image on the recording sheet.

9. An image forming apparatus, comprising:

a recording sheet bearing member for bearing a recording sheet on which an image is to be formed;

a charger brush contacting with a surface of said recording sheet bearing member opposite to a surface thereof on which the recording sheet is carried, and adapted to apply charge to said recording sheet bearing member; and a grounded conductive member arranged within a range of movement of a tip of said charger brush, and having an insulation member between said conductive member and said charger brush.

10. An image forming apparatus according to claim 9, wherein said conductive member is grounded via a resistor.

11. An image forming apparatus according to claim 9, wherein said conductive member supports said recording sheet bearing member.

12. An image forming apparatus according to claim 9, wherein said conductive member has opposed ring portions between which said charger brush is disposed, and said ring portions support said recording sheet bearing member.

13. An image forming apparatus according to claim 9, further comprising an image bearing member, and wherein an image formed on said image bearing member is transferred onto the recording sheet born by said recording sheet bearing member.

14. An image forming apparatus according to claim 9, wherein, before the image is formed on the recording sheet, said recording sheet can be electrostatically adhered to said recording sheet bearing member.

15. An image forming apparatus according to claim 13, wherein the image formed on said image bearing member is transferred onto the recording sheet carried by said recording sheet bearing member, by means of said charger brush.

16. An image forming apparatus according to claim 13, wherein a plurality of color images can be formed on said image bearing member, and said plurality of color images are successively transferred onto the recording sheet carried by said recording sheet bearing member in a superimposed fashion.

17. An image forming apparatus according to claim 16, wherein the image forming apparatus can form a full-color image on the recording sheet.

18. An image forming apparatus according to claim 9, wherein said insulation member has a sheet-shape.

* * * * *

UNITED STATES PATENT AND TRADEMARK OFFICE

CERTIFICATE OF CORRECTION

PATENT NO. : 5,335,053
DATED : August 2, 1994
INVENTOR(S) : TAKASHI HASEGAWA

It is certified that error appears in the above-indentified patent and that said Letters Patent is hereby corrected as shown below:

Column 6,
line 40, "born" should read --borne--;
line 49, "formed" should read --forming--;
line 58, "born" should read --borne--; and
line 66, "born" should read --borne--.

Column 8,
line 7, "born" should read --borne--.

Signed and Sealed this

Thirteenth Day of December, 1994

Bruce Lehman

*Attest:*

BRUCE LEHMAN

*Attesting Officer*

*Commissioner of Patents and Trademarks*